US005630259A

United States Patent [19]

Ricketts

[11] Patent Number: 5,630,259

[45] Date of Patent: May 20, 1997

[54] NECKERCHIEF SLIDE

[76] Inventor: E. Randall Ricketts, 16198 C.R. 434, Lindale, Tex. 75771

[21] Appl. No.: 498,117

[22] Filed: Jul. 5, 1995

[51] Int. Cl.[6] ..... A44B 6/00; A41F 1/00

[52] U.S. Cl. ..... 24/482; 24/49.1; 24/66.11; 24/300

[58] Field of Search ..... 24/482, 300, 49.1, 24/66.9, 66.11, 129 D, 115 H, 30.5 R, 30.5 S; 2/152.1, 153, 155, 156

[56] References Cited

U.S. PATENT DOCUMENTS

| | | | |
|---|---|---|---|
| 144,170 | 8/1873 | Weisz . | |
| 350,523 | 10/1886 | Bodley | 24/482 |
| 1,151,065 | 8/1915 | Terry . | |
| 1,185,348 | 5/1916 | Rutledge et al. | 24/66.9 |
| 1,513,998 | 11/1924 | Kapfer | 24/66.9 |
| 1,624,737 | 9/1927 | Jensen . | |
| 2,002,825 | 5/1935 | McWhirter | 2/155 |
| 3,183,612 | 5/1965 | Romaine | 40/1.5 |
| 4,000,523 | 1/1977 | Woods | 24/49.1 |
| 4,270,247 | 6/1981 | Freedom | 24/30.5 R |
| 4,542,537 | 9/1985 | Plapp et al. | 2/148 |
| 4,724,547 | 2/1988 | Kawamura | 2/153 |
| 5,000,747 | 3/1991 | Cardo et al. | 24/30.5 R |
| 5,035,002 | 7/1991 | Knight, Jr. | 2/152 |
| 5,062,184 | 11/1991 | Rowland | 24/300 |
| 5,347,671 | 9/1994 | Hunts | 24/30.5 R |

FOREIGN PATENT DOCUMENTS

| | | | |
|---|---|---|---|
| 3009689 | 5/1993 | European Pat. Off. | 24/66.11 |

*Primary Examiner*—Victor N. Sakran
*Attorney, Agent, or Firm*—Baker & Botts, L.L.P.

[57] ABSTRACT

A method and apparatus for retaining neckerchiefs scarves, handkerchiefs, bandannas, and/or other deformable items is disclosed. One embodiment of the invention is a neckerchief slide comprising a body having a cavity through it. A first post and a second post connect to the body on opposite sides of the cavity. The first and second posts are capable of securing an elastic band such that the elastic band extends across the cavity.

20 Claims, 2 Drawing Sheets

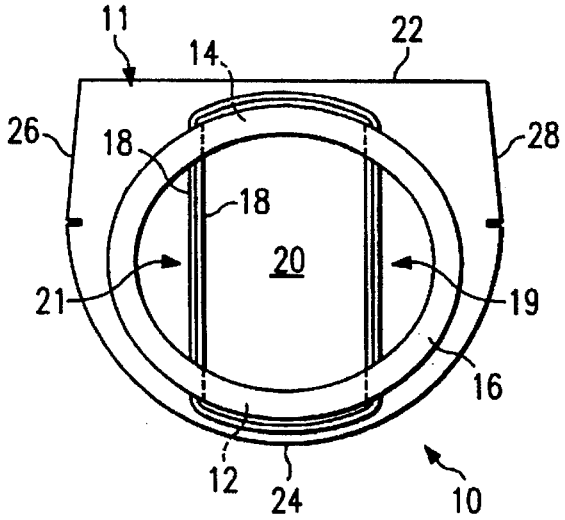
FIG. 2
FIG. 3
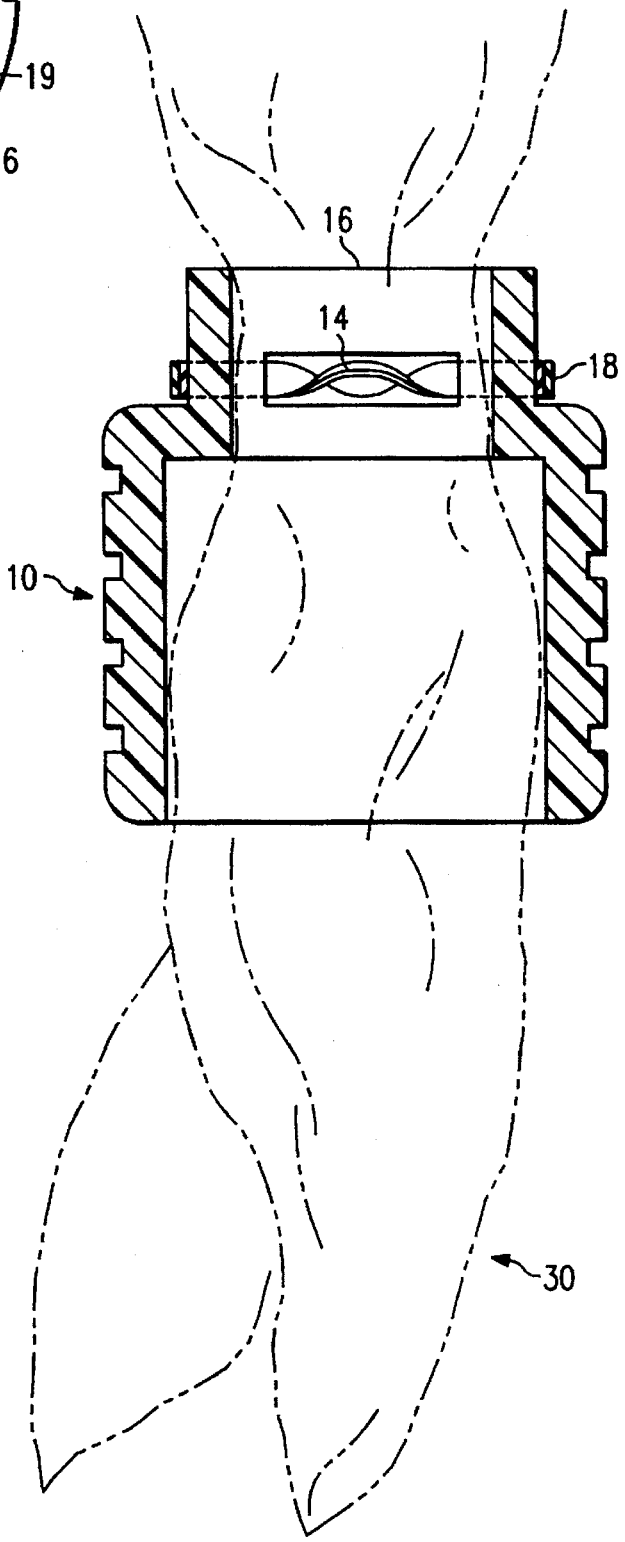
FIG. 1
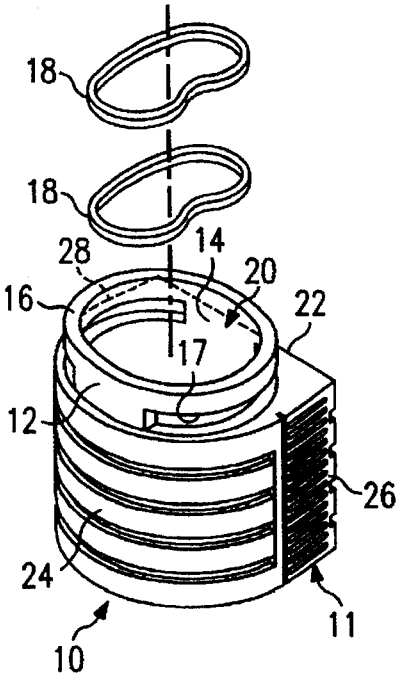

NECKERCHIEF SLIDE

TECHNICAL FIELD OF THE INVENTION

The present invention relates generally to retaining devices and more particularly to a method and apparatus for retaining neckerchiefs, scarves, and bandannas.

BACKGROUND OF THE INVENTION

A neckerchief is a triangular-shaped handkerchief designed to be worn around the neck of the user and normally retained in place by a device known as a neckerchief slide. Neckerchief slides are also sometimes referred to as clips or clasps. The user of the neckerchief drapes the neckerchief around his neck and secures it by sliding the ends of the neckerchief through the neckerchief slide until the slide has reached a desirable position. Other items worn around the neck such as scarves and/or bandannas are sometimes similarly secured by some type of slide.

Existing slides are carefully designed such that the volume of material extending through the slide is matched to the dimensions of the slide passage. If the slide is too small, the neckerchief material cannot be pulled through it. If the slide is too large, it will not retain the neckerchief in position as it will slide off.

Due to these limitations, existing neckerchief slides often do not securely retain the neckerchief in position. For example, Boy Scouts wear a neckerchief with their uniforms. Boy Scouts frequently participate in athletic activities during meetings and on camping trips. During such activities, the movement of the neckerchief and slide can cause the slide to dislodge and fall off. Bumping the neckerchief slide can also cause it to dislodge and fall off. Also, vibrations caused by ordinary body movements can cause the neckerchief slide to gradually loosen and fall off. For these reasons, Boy Scouts often lose their neckerchief slides. Similarly, women often lose slides securing scarves and/or bandannas.

SUMMARY OF THE INVENTION

The present invention comprises a method and apparatus for securely retaining a neckerchief, scarf, bandanna or other compressible item. One embodiment of the invention is a neckerchief slide comprising a body having a cavity extending through the body. Two posts are connected to the body on opposing sides of the cavity. The posts may secure an elastic band such that the elastic band extends across the cavity.

A second embodiment of the invention is a neckerchief slide also comprising a body having a cavity through it. In this embodiment, a slot is formed in some portion of the body. The slot is operable to secure an elastic band such that the elastic band extends across the cavity.

A third embodiment of the invention is a neckerchief slide comprising a body having a cavity through it. Inside the cavity, a plurality of resilient members extend from the interior wall. These members resist removal of a compressible item, such as a neckerchief, after the item has been inserted into the cavity.

One important advantage of the present invention is that the neckerchief slide will stay in position on the neckerchief, scarf, handkerchief, bandanna, and/or other compressible item despite a high degree of physical activity by the person wearing the slide. The slide is more difficult to dislodge than existing slides. The dimensions of the cavity in the invention need not be as carefully matched to the volume of material extending therethrough because the elastic band and/or elastic fingers self-adjust to the volume of material pulled through the slide. The slide of the present invention may thus be used with a wider range of neckerchiefs, handkerchiefs, scarves, bandannas, and other compressible items. Although the disclosed slide retains its position better, it is as easy to use as existing slides.

The body of the slide can also have both flat and curved surfaces to which items may be secured. For example, items such as coins, medallions, seashells, fossils, etc., could be glued to the body of the slide. Alternatively, hook and loop fasteners could be used to allow various items to be interchangeably mounted on the slide so that the user could display different items on different occasions.

BRIEF DESCRIPTION OF THE DRAWINGS

For a more complete understanding of the present invention, and the advantages thereof, reference is now made to the following descriptions taken in conjunction with the accompanying drawings, in which:

FIG. 1 illustrates a perspective view of a first embodiment of a neckerchief slide constructed in accordance with the teachings of the invention;

FIG. 2 illustrates a top view of the neckerchief slide of FIG. 1;

FIG. 3 illustrates a cross-sectional side view of the slide of FIG. 1 secured to a neckerchief;

DETAILED DESCRIPTION OF THE INVENTION

Figure 4:
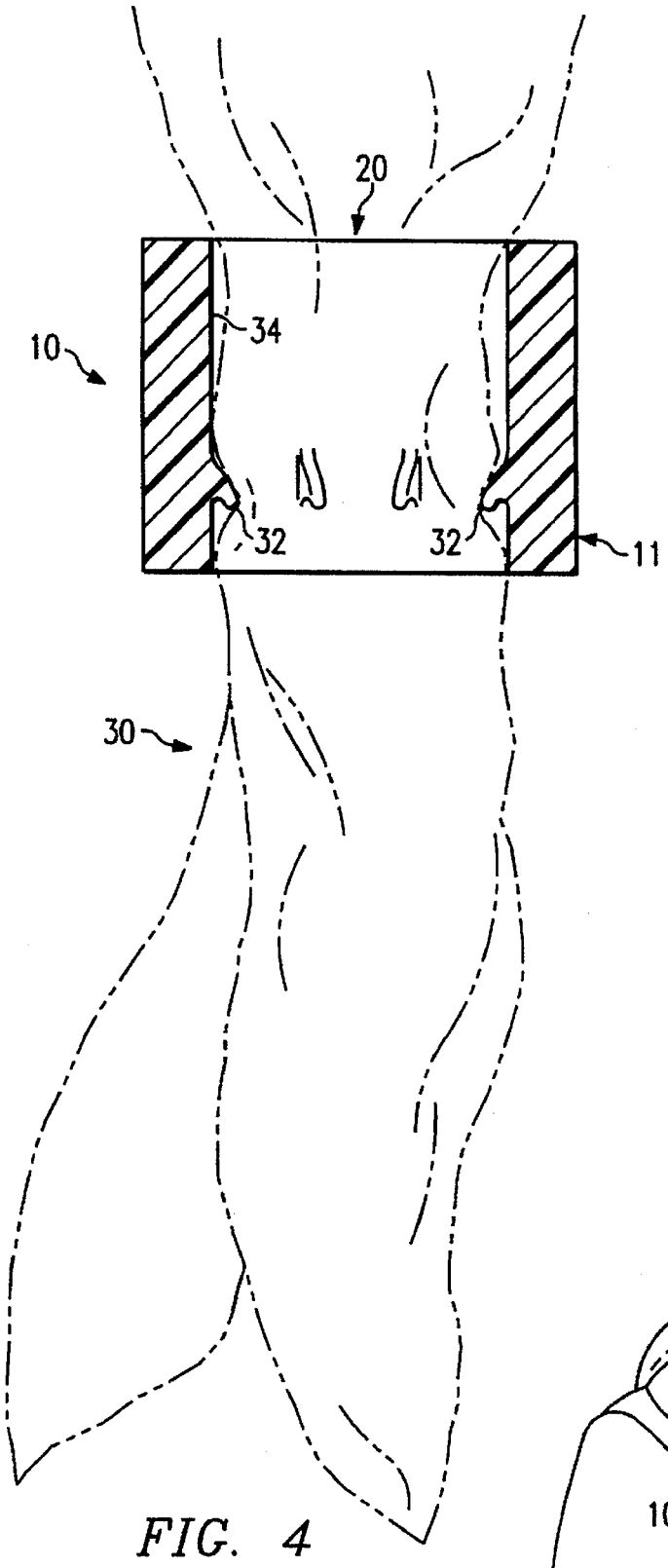
FIG. 4 illustrates a cross-sectional side view of a second embodiment of the invention secured to a neckerchief.

The preferred embodiment of the present invention and its advantages are best understood by referring to FIGS. 1 through 6 of the drawings, like numerals being used for like and corresponding parts of the various drawings.

FIG. 1 illustrates a first embodiment of a neckerchief slide 10 constructed in accordance with the invention. The term "neckerchief slide" herein refers to any slide constructed in accordance with the teachings of the present invention. The slide need not be used to retain a neckerchief in position. The neckerchief slide could be used to retain any type of compressible item such as a neckerchief, scarf, handkerchief or bandanna. In addition, the neckerchief slide need not be used to retain an item around the neck. The present invention could be used to secure any type of compressible item in any position on a person or elsewhere.

Neckerchief slide 10 comprises a body 11 having a cavity 20 running therethrough. Neckerchief slide 10 further comprises post 12 and post 14. Post 12 and post 14 are connected to body 11 on opposing sides of cavity 20. Post 12 and post 14 are used to secure one or more elastic bands 18 such that the elastic bands 18 extend across the cavity. In this embodiment, opposing sides of each elastic band 18 are fixed by post 12 and post 14 in an opposed parallel relation to one another and extending across cavity 20. Ring 16 connects to post 12 and post 14 and forms a slot 17 between ring 16 and body 11 around a portion of cavity 20. Slot 17 helps secure elastic bands 18 to prevent them from dislodging from post 12 and post 14.

Body 11 further comprises first surface 22, second surface 24, third surface 26 and fourth surface 28. First surface 22 is substantially flat to allow various objects to be secured to body 11. For example, the user of neckerchief slide 10 may desire to attach a medallion, a seashell, a fossil, or some other type of small ornamental object so as to display that object while wearing neckerchief slide 10. Such an object can be glued to first surface 22 or attached to first surface 22 using hook and loop fasteners. The object could also be attached with other fasteners such as magnets, screws, or slots molded into the surface of body 11. First surface 22 is textured so as to better secure an object glued to it.

Sometimes, however, the user of neckerchief slide 10 will desire to display a curved object while wearing neckerchief slide 10. For example, a user might want to display a curved medallion such as a medallion made for mounting on a walking stick. Second surface 24 is curved to allow mounting of such objects. Second surface 24 has a texture similar to that of first surface 22 so that an object is easily glued to it. Neckerchief slide 10, then, is reversible as it can be worn with an object mounted either on first surface 22 or second surface 24. In this embodiment, a series of parallel grooves was chosen for the texture to aid in molding slide 10. This texture improves the setup of plastic inside the mold as it avoids undercutting. Depending upon the mold and/or process used, other textures such as a cross-hatch texture can also be used.

Third surface 26 and fourth surface 28 allow the user of neckerchief slide 10 to easily grasp body 11 when sliding neckerchief slide 10 on or off of the item that slide 10 is retaining. Third surface 26 and fourth surface 28 are textured to allow the user to better grip neckerchief slide 10. Third surface 26 and fourth surface 28 are substantially perpendicular to first surface 22 but can also be angled towards or away from first surface 22.

FIG. 2 illustrates a top view of neckerchief slide 10. FIG. 2 more clearly illustrates how post 12 and post 14 secures elastic bands 18 such that elastic bands 18 extend across cavity 20. As illustrated, a first portion 19 of each elastic band 18 extends across cavity 20 in an opposed relation to a second portion 21 of each elastic band 18. In this example, first portion 19 and second portion 21 of each elastic band 18 are substantially parallel to one another. First portion 19 and second portion 21 could also be angled to one another. In addition, post 12 and post 14 could be placed on body 10 such that only first portion 19 of each elastic band 18 extends across cavity 20 while second portion 21 of each elastic band 18 does not extend across cavity 20.

This FIGURE also better illustrates the position of post 12, post 14, and ring 16. The posts 12 and 14 are positioned at a point inside the circumference of body 11. Although these posts could be positioned anywhere, their position in this embodiment allows elastic bands 18 to be affixed and removed from body 11 even after an object has been affixed to first surface 22 or second surface 24 for display. Positioning posts 12 and 14 on the outer circumference of body 11 could make it more difficult to affix or remove elastic bands 18 when an object is affixed to body 11. Similarly, in this embodiment, ring 16 has a circumference smaller than that of body 11.

FIG. 3 illustrates a side cross-sectional view of neckerchief slide 10 retaining neckerchief 30. This FIGURE illustrates the operation of neckerchief slide 10. The ends of neckerchief 30 pass through both cavity 20 and the loop formed by first portion 19 and second portion 21 of elastic bands 18. If an embodiment is being used where only first portion 19 of elastic bands 18 extends across cavity 20, then the ends of neckerchief 30 are passed through cavity 20 and the opening formed between first portion 19 of elastic band 18 and a side wall of cavity 20. The user may then slide neckerchief slide 10 up or down the length of neckerchief 30 while grasping the ends of the neckerchief. After the desired amount of material has been pulled through neckerchief slide 10, slide 10 is retained in position by elastic bands 18 and/or cavity 20. As the material is pulled through cavity 20 in the loop formed by first portion 19 and second portion 21 of elastic bands 18, elastic bands 18 are stretched and deformed outward towards the sidewall of cavity 20. The force exerted against the material of neckerchief 30 by deformed elastic bands 18 coupled with frictional resistance to movement of the material relative to elastic bands 18 combines to secure neckerchief slide 10 in the desired position.

FIG. 3 also illustrates how the lower portion of cavity 20 has a larger diameter than the upper portion. Although other configurations can be used, this configuration allows the neckerchief to flare closer to elastic bands 18. This flaring effect increases the effectiveness of elastic bands 18 in securing slide 10 to neckerchief 30.

Neckerchief slide 10 is preferably used with two elastic bands 18. Using two elastic bands 18 increases the constricting force on the material of neckerchief 30. In addition, the two elastic bands 18 roll as the material is pulled through body 11, causing an irregular surface texture that increases the resistance to movement of the material relative to elastic bands 18. The rolling of elastic bands 18 also creates a torsion effect resisting the movement of neckerchief slide 10 on neckerchief 30. After moving slide 10 a small amount, this torsion effect causes slide 10 to return to its original position. This effect advantageously allows slide 10 to maintain its position when jarred by a force that would dislodge a rigid slide.

Although the invention preferably employs two elastic bands 18, either one elastic band 18 or more than two elastic bands 18 could be used. Elastic bands 18 are rubber bands, but other materials could be used. A single set of posts is used in this embodiment for mounting elastic bands 18, but multiple sets of posts and/or multiple slots could be formed at various positions along body 11 so as to secure multiple sets of elastic bands 18 across cavity 20.

Cavity 20 in this embodiment is circular. Cavity 20 could also have a different shape. Similarly, body 11 of this embodiment has a shape defined by first surface 22, second surface 24, third surface 26 and fourth surface 28. Body 11 could have other shapes and could also have ornamentation molded into its surface. First surface 22, second surface 24, third surface 26, and fourth surface 28 are textured but could also be smooth.

In an alternative embodiment, a slot is formed on some portion of body 11. The slot is operable to secure elastic bands 18 such that elastic bands 18 extend across the cavity. In the embodiment illustrated in FIG. 1, a slot 17 is formed by post 12, post 14, and ring 16. In an alternative embodiment (not explicitly shown), a slot could be formed, for example, in the middle of body 11 rather than on the end. Also, multiple slots could be formed on the body to provide additional securing force when elastic bands 18 are attached.

FIG. 4 illustrates a cross-sectional view of another embodiment of the invention attached to neckerchief 30. In this embodiment, neckerchief slide 10 comprises a plurality of resilient members 32 connected to the interior wall 34 of cavity 20. Resilient members 32 can be made of rubber or any other resilient material. Body 11 of this embodiment can have any shape, including the shape of the embodiment illustrated in FIG. 1. Resilient members 32 may extend through slots or apertures in interior wall 34 or can be connected to an annular ring connected to interior wall 34 of cavity 20.

In operation of this embodiment, the user inserts the ends of neckerchief 30 through cavity 20 and slides neckerchief slide 10 along the material of neckerchief 30. As the user slides neckerchief slide 10 onto neckerchief 30, the resilient members 32 deform in the same direction as the material of neckerchief is being pulled. Deformation of members 32 causes them to deflect outward toward interior wall 34 of cavity 20. Once neckerchief slide 10 is fixed in place, resilient members 32 produce a force directed inward to retain neckerchief slide 10 in position. In addition, resilient members 32 resist the sliding of neckerchief slide 10 along the material of neckerchief 30 due to frictional force.

Figure 5:
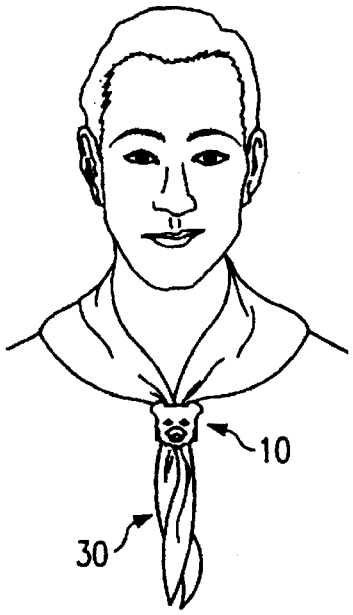
FIG. 5 illustrates the invention being used to secure a neckerchief on a Boy Scout's uniform.

FIG. 5 illustrates neckerchief slide 10 retaining a neckerchief 30 in position on a Boy Scout uniform. This example illustrates one use of neckerchief slide 10. A small ornamental bear head has been attached to first surface 22 of neckerchief slide 10.

Figure 6:
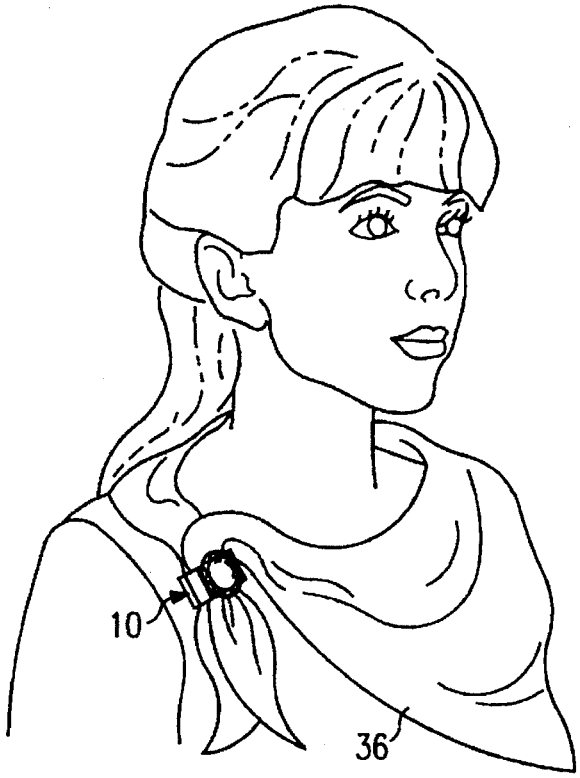
FIG. 6 illustrates the invention being used to secure a woman's scarf.

FIG. 6 illustrates how neckerchief slide 10 can be used to retain a woman's scarf 36 in position. In this example, a medallion has been affixed to first surface 22.

Although the present invention and its advantages have been described in detail, it should be understood that various changes, substitutions and alterations can be made therein without departing from the spirit and scope of the invention as defined by the appended claims.

What is claimed is:

1. A neckerchief slide, comprising:

a body having a cavity therethrough, the cavity comprising a closed elongated opening, a first post and a second post, the first post and second post connected to the body on opposing sides of the cavity, wherein the first post and second post are operable to secure an elastic band such that the elastic band extends across the cavity, and a first elastic band secured to the body by the first post and second post, a first portion of the first elastic band extending across the cavity in opposed relation to a second portion of the first elastic band extending across the cavity.

2. The neckerchief slide of claim 1, the body further comprising a first surface substantially parallel to an axis of the cavity, wherein the first surface is substantially flat.

3. The neckerchief slide of claim 2, the body further comprising a third surface opposed to a fourth surface, the third surface and the fourth surface substantially perpendicular to the first surface, wherein the third surface and the fourth surface are textured.

4. The neckerchief slide of claim 3, further comprising:

a ring connected to the first post and the second post, the ring forming a slot between the ring and the body around a portion of the cavity, and wherein the body further comprises a second surface substantially parallel to the axis of the cavity, wherein the second surface is curved.

5. The neckerchief slide of claim 2, wherein the first surface is textured.

6. The neckerchief slide of claim 1, further comprising:

a second elastic band secured to the body by the first post and second post, a first portion of the second elastic band extending across the cavity in opposed relation to a second portion of the second elastic band extending across the cavity.

7. The neckerchief slide of claim 1, the body further comprising a second surface substantially parallel to an axis of the cavity, wherein the second surface is curved.

8. The neckerchief slide of claim 7, wherein the second surface is textured.

9. The neckerchief slide of claim 1, further comprising:

a ring connected to the first post and the second post, the ring forming a slot between the ring and the body around a portion of the cavity.

10. A neckerchief slide, comprising:

a body having a cavity therethrough, the cavity comprising a closed elongated opening, an elongated slot formed on and extending through a portion of the body and operable to secure an elastic band such that the elastic band extends across the cavity, and an elastic band secured by the slot, a first portion of the band extending across the cavity in opposed relation to a second portion of the band extending across the cavity.

11. The neckerchief slide of claim 10, the body further comprising a first surface substantially parallel to an axis of the cavity, wherein the first surface is substantially flat.

12. The neckerchief slide of claim 11, the body further comprising a third surface opposed to a fourth surface, the third surface and the fourth surface substantially perpendicular to the first surface, wherein the third surface and the fourth surface are textured.

13. The neckerchief slide of claim 10, the body further comprising a second surface substantially parallel to an axis of the cavity, wherein the second surface is curved.

14. A method for retaining a compressible item, comprising:

forming a body having a cavity therethrough, the cavity comprising a closed elongated opening;

forming an elongated slot adjacent to a portion of the body and operable to secure an elastic band such that the elastic band extends across the cavity;

securing an elastic band across the cavity to form a loop, the elastic band secured by the slot;

passing a portion of the compressible item through the cavity and through the loop.

15. The method of claim 14, wherein the body further comprises a first surface substantially parallel to an axis of the cavity, wherein the first surface is substantially flat.

16. The method of claim 15, wherein the body further comprises a third surface opposed to a fourth surface, the third surface and the fourth surface substantially perpendicular to the first surface.

17. The method of claim 16, wherein the slot is formed by connecting a first post and a second post on opposing sides of the cavity and connecting a ring to the first post and second post, the ring forming a slot between the ring and the body around a portion of the cavity.

18. The method of claim 14, wherein the body further comprises a second surface substantially parallel to an axis of the cavity, wherein the second surface is curved.

19. The method of claim 14, wherein the slot is formed by connecting a first post and a second post on opposing sides of the cavity and connecting a ring to the first post and second post, the ring forming a slot between the ring and the body around a portion of the cavity.

20. The method of claim 14, wherein the elongated slot is formed by creating an elongated slot extending through a portion of the body.

* * * * *